United States Patent [19]

Genese

[11] 4,169,475

[45] Oct. 2, 1979

[54] ADDITIVE TRANSFER UNIT

[75] Inventor: Joseph N. Genese, Waukegan, Ill.

[73] Assignee: Abbott Laboratories, North Chicago, Ill.

[21] Appl. No.: 858,494

[22] Filed: Dec. 8, 1977

[51] Int. Cl.[2] ..... A61J 1/00

[52] U.S. Cl. ..... 128/272.3; 141/329

[58] Field of Search ..... 128/272.3, 272, 218 R, 128/218 M; 141/329

[56] References Cited

U.S. PATENT DOCUMENTS

| | | | |
|---|---|---|---|
| 3,788,369 | 1/1974 | Killinger | 128/272.3 X |
| 3,826,260 | 7/1974 | Killinger | 128/272 |
| 3,945,382 | 3/1976 | Ogle | 128/272 |
| 3,987,791 | 10/1976 | Chittenden | 128/272.3 |
| 4,059,112 | 11/1977 | Tischlinger | 128/272.3 |

FOREIGN PATENT DOCUMENTS

| | | | |
|---|---|---|---|
| 2356397 | 1/1975 | Fed. Rep. of Germany | 128/272.3 |

*Primary Examiner*—Robert E. Bagwill
*Attorney, Agent, or Firm*—Robert L. Niblack; Neil E. Hamilton

[57] ABSTRACT

An additive transfer device for storing and transferring of a medicament to a solution container such as an I.V. bag having an exposed port. The transfer device includes a vial-type container having a slidable pierceable sealing element. A holder member secures a piercing cannular member and the holder has a guide means at one end to fit around th exposed port of the I.V. bag. A cover extends over the guide means and is in sealing contact with the vial. Activating means are provided in conjunction with the cover, the holder and the vial to effect movement of the holder member toward the vial and piercing of the vial stopper by one end of the cannula. With a piercing of the I.V. port by means of the other pointed end of the cannula, communication can be made between the additive container and the I.V. bag.

14 Claims, 12 Drawing Figures

ADDITIVE TRANSFER UNIT

BACKGROUND OF THE INVENTION

This invention relates to a device for storing and transferring a medicament to a flexible container such as an I.V. bag. More particularly, the invention relates to an additive transfer device wherein a slidable sealing element in a vial container for the medicament is pierced by means of a simple movement of the container toward the cover and upon removal of the cover the contents of the container can be delivered through the port of an I.V. bag by movement of the slidable sealing element toward the end wall of the vial container.

Additive transfer units of the type concerned with in this invention are described in U.S. Pat. Nos. 3,033,202; 3,788,369; 3,826,260; 3,828,779; 3,938,520 as well as 3,987,791 and Belgium Pat. No. 850.121. Many of the units described in these patents, for example in U.S. Pat. No. 3,033,202; 3,938,520; 3,987,791 and Belgium Patent 850.121 are not specifically directed to a device for making an addition to a flexible I.V. bag. In the instance of U.S. Pat. No. 3,788,369 and 3,828,779 which are so directed, a specially designed closure for a vial or a large, multicomponent device is indicated as well as in U.S. Pat. No. 3,826,260. The prior art nowhere provides a simplified, compact and ready to use transfer unit for making additions to an I.V. flexible container. In particular, the prior art does not provide an additive device for use with an I.V. bag wherein a simple movement of the container vial can be employed to cause a piercing member to pierce through a slidable seal in the container vial and afford communication between the small volume container and the I.V. bag. The opposing end of the piercing cannula is then inserted through the bag port and the contents of the container expelled with a movement of the vial over a holder member for the cannula.

It is an advantage of the present invention to afford a novel additive transfer device which is specifically adapted for use with a flexible container. Other advantages are an additive transfer unit which is employed with a small volume container having a slidable piercing element; utilizes a minimum number of parts and a minimum number of interfitting components; and can be activated in a fast manner while having a cover member serve multiple functions.

SUMMARY OF THE INVENTION

The foregoing advantages are accomplished and the shortcomings of the prior art are overcome by the present additive transfer unit which employs an additive transfer container having a slidable, pierceable stopper. A holder member for a piercing cannula is positioned with the cannula at one end of the holder, out of contact with the pierceable stopper. The opposing end of the holder defines a guide means to surround the extending port of an I.V. plastic bag. A cover extends over the holder member and is in sealing contact with the additive container. Activating means are associated with the cover, the holder and the additive container to effect movement of the holder toward said additive container with a piercing of the additive container stopper. Upon removal of the cover, the guide means will be placed over and around the pierceable closure of the solution container. With the opposing end of the cannula extending through the solution container closure, fluid communication is made between the two containers. The contents of the additive container can be expelled into the solution container by movement of the additive container over the holder while the additive container stopper is held in a fixed position. In a preferred manner, the activating means for movement of the holder with the cannula toward the additive container is afforded by complementary threads carried by the additive container and the holder. When rotary movement is imparted to either the additive container or the cover, or both, engagement means associated with the cover and the holder will prevent movement of the holder so that the threads on the holder and the additive container will interengage to effect the puncture of the additive container stopper.

BRIEF DESCRIPTION OF THE INVENTION

A better understanding of the additive transfer unit of this invention will be afforded by reference to the drawing wherein.

DESCRIPTION OF THE INVENTION

Figure 1:
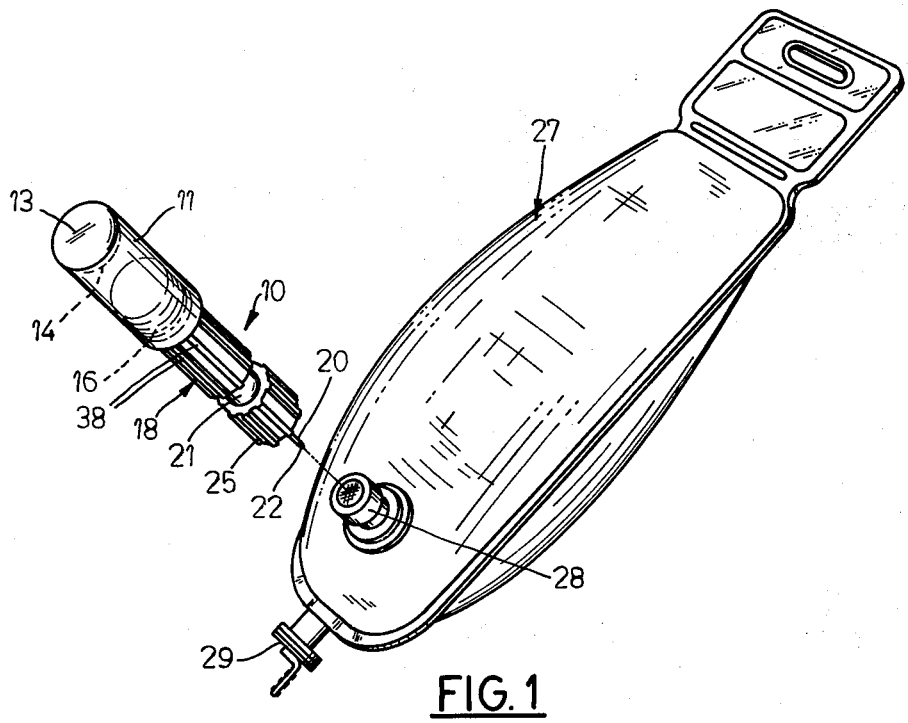
FIG. 1 is a perspective view of the transfer unit of this invention with the cover removed and orientated with the additive port of an I.V. solution bag.
Figure 2:
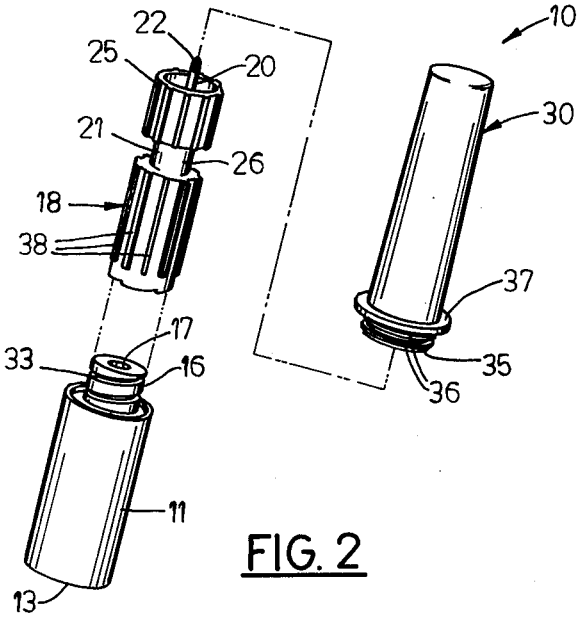
FIG. 2 is an assembly view in perspective showing the transfer device.

Proceeding to a detailed description of the embodiment of the invention, the additive transfer device 10, as shown in FIG. 1 is orientated for communication with a solution container in the form of an I.V. bag 27. Bag 27 is of the type described in U.S. Pat. No. 3,915,212 entitled "Flexible Medicinal Fluid Container Having a Combined Fill Administration Port and Reinforced Hanger" and is commonly assigned. It has the usual protruding additive port 28 and an administration port 29. Transfer device 10 includes an additive container in the form of a vial 11 having a pierceable and slidable stopper 16 for sealably enclosing an I.V. additive medicament 14. A holder member 18 is secured to stopper 16 at one end and has a guide means 25 at the opposing end for surrounding additive port 28. As best seen in FIG. 2, additive transfer device 10 is basically a three component unit which in addition to vial 11 and engageable holder member 18, includes a cover member 30. The cover is removed prior to penetration with additive port 28.

Figure 3:
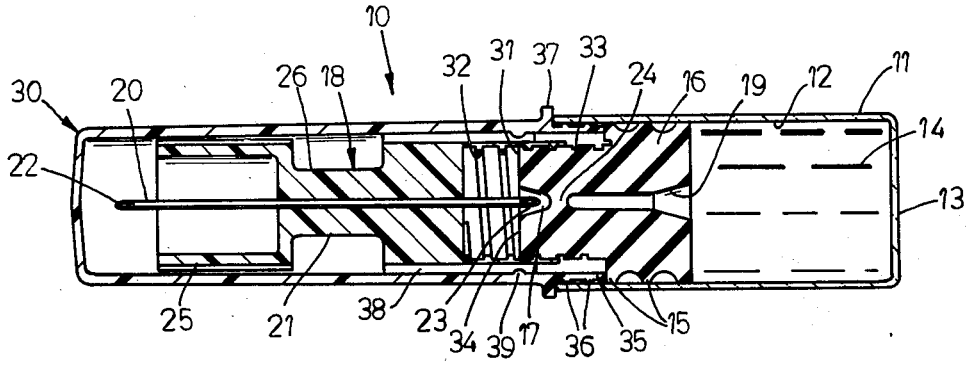
FIG. 3 is a view in vertical section of the transfer unit in an inactivated state.
Figure 4:
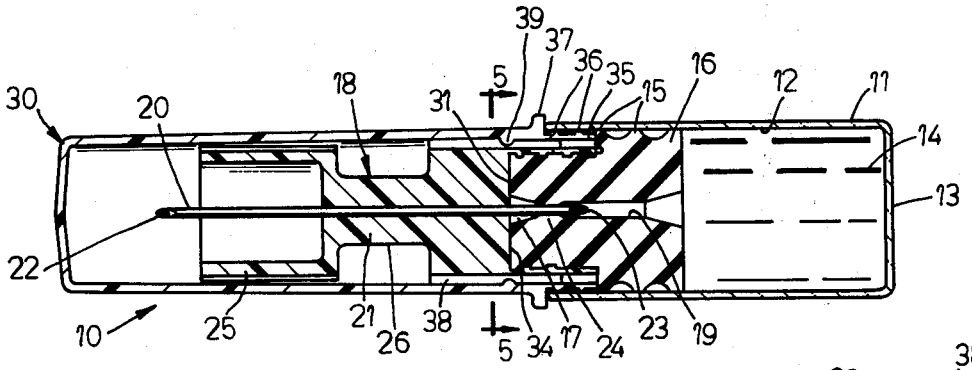
FIG. 4 is a view similar to FIG. 3 except showing the transfer unit in an activated state.
Figure 5:
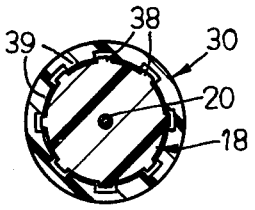
FIG. 5 is a view in vertical section taken along line 5—5 of FIG. 4.
Figure 6:
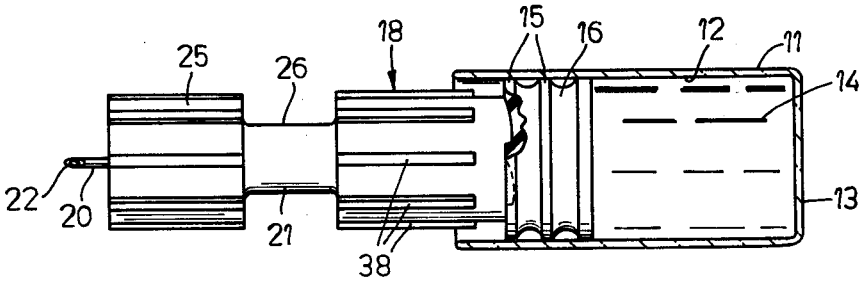
FIG. 6 is a view in side elevation with portions broken away showing the transfer unit ready for piercing an I.V. bag as in FIG. 1.
Figure 7:
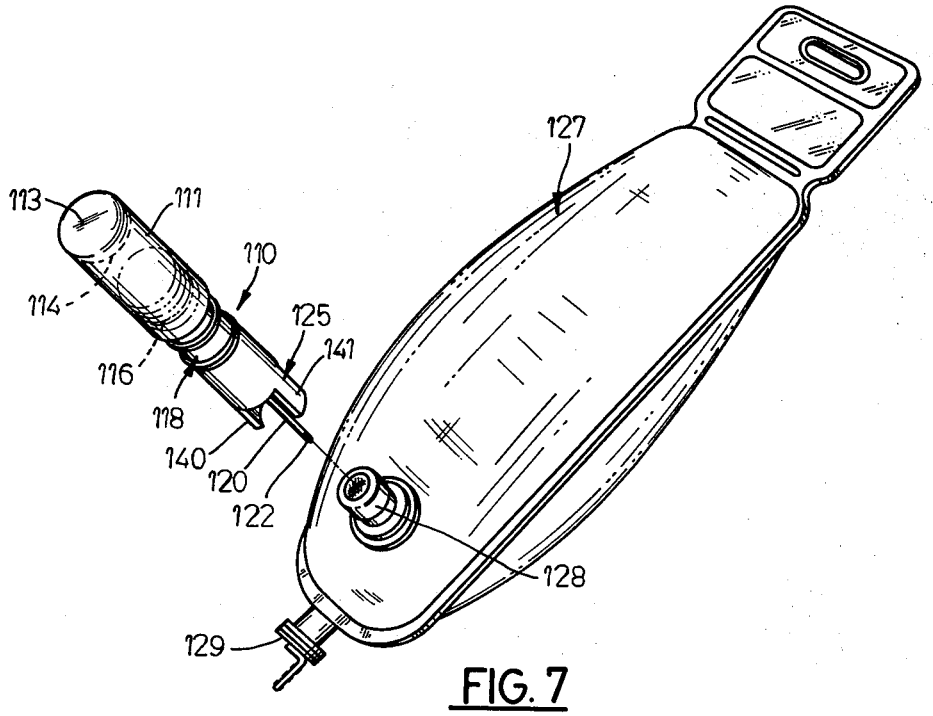
FIGS. 7, 8, 9, 10, 11 and 12 illustrate an alternative embodiment and correspond to FIGS. 1, 2, 3, 4, 5 and 6, respectively.
Figure 8:
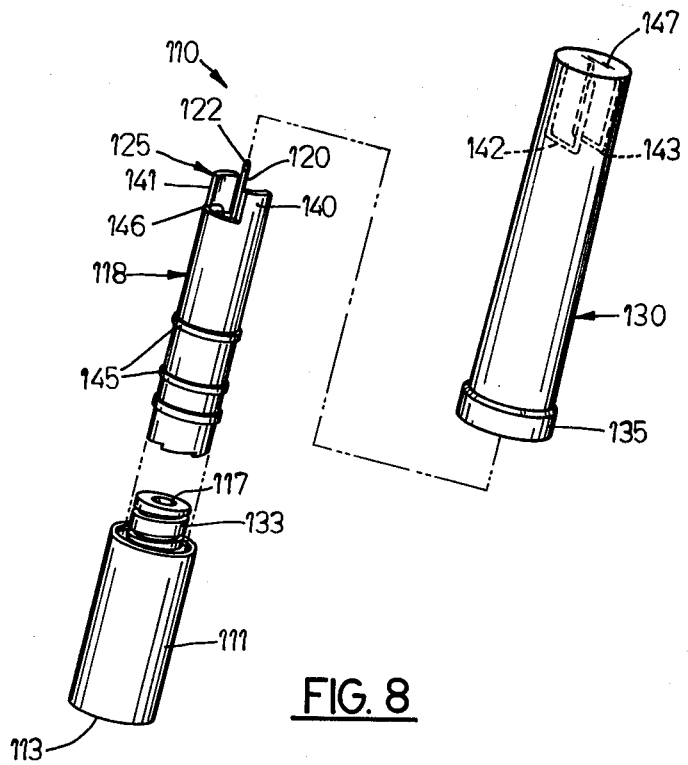

Referring to FIGS. 3 and 4, it will be seen that cover 30 has a reduced shoulder 35 with sealing rings 36 for engagement with the inside wall 12 of container vial 11. A shoulder stop 37 on cover 30 also aids in placement and sealing of cover 30 onto vial 11. Additive container stopper 16 is of a generally well known type and has sealing rings 15 for slidable engagement over the inside of container 11. Two oppositely disposed and centrally positioned channels 17 and 19 provide a pierceable diaphragm section 24. Extending from stopper 16 is an externally threaded section 33 for engagement with complementary internal threads 32 in holder 18. Positioned centrally in holder 18 is a hollow piercing member 20 having opposing piercing points 22 and 23. Piercing member 20 is secured in the intermediate portion 21 of holder 18 which also provides a circumferential groove 26. A guide means in the form of a hollow compartment 25 extends from holder 18 opposite its engagement with stopper 16. It will be noted that piercing member 20 is centrally positioned in guide means 25 and extends a short distance outwardly therefrom.

An important aspect in effecting a piercing of point 23 of piercing member 20 through the diaphragm 24 of stopper 16 is the provision of longitudinally extending rib members 38 which are provided on the external surface of holder member 18. Cover 30 has projections or ribs 39 which will fit between rib members 38 and afford an interference fitment to prevent rotation of holder 18, as will be further explained in the Operation.

DESCRIPTION OF ANOTHER EMBODIMENT

In the following FIGS. 7–12, another embodiment of the previously described administration apparatus 10 is illustrated. Similar parts will be referred to with similar numbers except that they will be in the "100" series.

The basic difference between additive transfer unit 110 and the previously described unit 10 is in the means for preventing rotation of holder 118 inside of cover 130. In place of rib members 38 and projections 39, there is provided two "U" shaped bar members 142 and 143 which are anchored in the end wall 147 of cover 130. Bar members 142 and 143 are spaced a sufficient distance apart to accommodate two leg portions 140 and 141 which extend from holder 118. The spaced-apart leg portions also serve as a guide means 125 similar to guide means 25 for unit 10.

Figure 9:
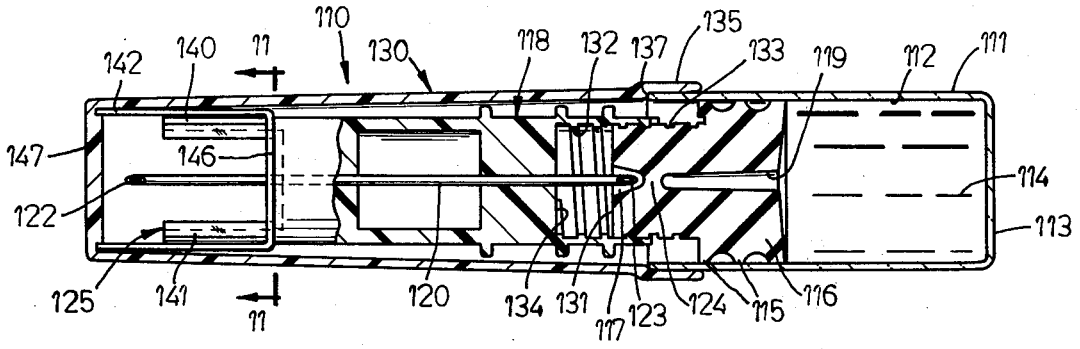
Figure 11:
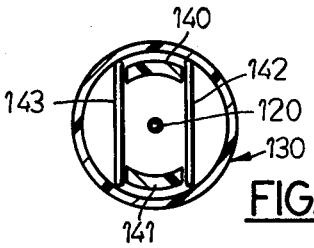
Figure 10:
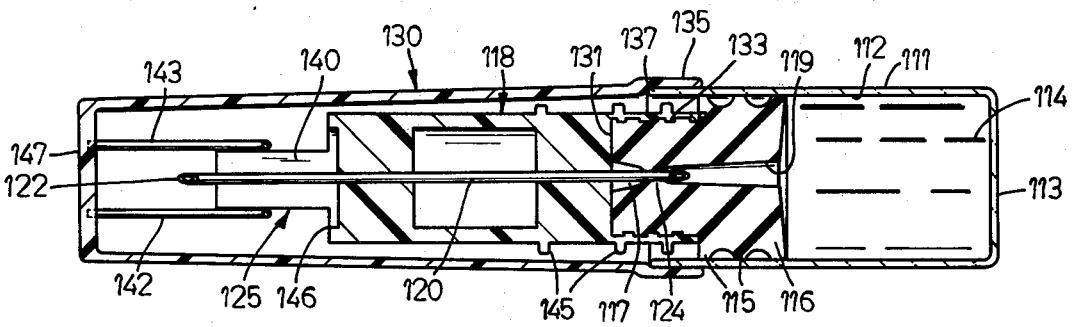
Figure 12:
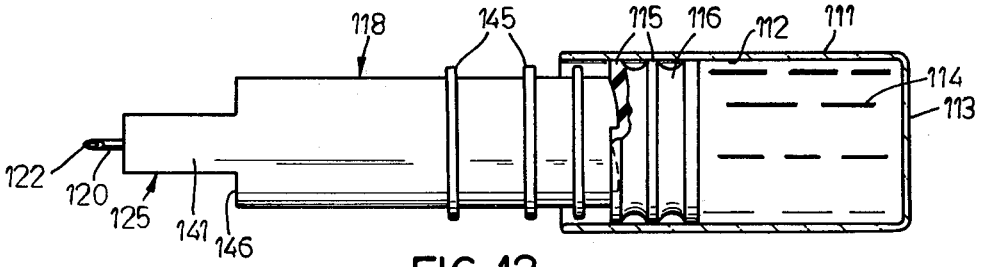

As best seen in FIG. 9, bar members 142 and 143 also serve as a spacing of holder 118 in cover 130 to prevent piercing point 122 from contacting end wall 147. This is accomplished by bar members 142 and 143 contacting the end wall 146 of holder 118 prior to contact of piercing point 122 with end wall 147 to provide stop portions.

Operation

A better understanding of the advantages of the additive transfer device 10 as well as 110 will be had by a description of the basic operation of unit 10. As unit 110 operates on basically the same principle, only embodiment 10 will be described with specific comments made for unit 110 in the manner in which it differs in its operation.

The additive transfer device 10 will be packaged in a sterile condition and be assembled as indicated in FIG. 3 with the piercing point 23 of piercing member 20 spaced a short distance from diaphragm section 24. In this position, external threads 33 of stopper 16 will partially engage internal threads 32 of holder 18. All that is required to activate unit 10 is to grasp the container vial 11 in one hand and the cover 30 in the other. A rotary motion imparted to cover 30 while either holding vial stationary or imparting a counter rotary motion will cause the threads 32 and 33 to further engage and piercing point 23 to move through diaphragm 24 until it assumes a position as shown in FIG. 4 and seated in channel 19. This movement will be afforded by projections 39 of cover 30 engaging with rib members 38 on holder 18 so that holder 18 will not move in rotary manner but will assume a linear movement inside cover 30 and move until the end of threaded section 31 of stopper 16 abuts against the end wall 34 of holder 18. In this position, cover 30 is then removed, such as indicated in FIG. 2 and unit 10 is then ready for guidance over and piercing through additive port 28, such as indicated in FIG. 1. After guide means 25 is positioned in a surrounding relationship to port 28 a minor force exerted on unit 10 will cause the piercing point 22 to pierce through additive port 28 and provide fluid communication with the inside of bag 27. With fluid communication thus afforded between bag and the inside of vial 11, all that is required to expel medicament 14 is to place the palm of one's hand over the end wall 13 of vial 11 and the forefingers around circumferential groove 26. Movement of the vial in the direction of holder 18 which will cause stopper 16 to move in the direction of wall 13 as the additive container moves over the stopper and the holder. After a sufficient quantity of the medicament is forced into bag 27, it is removed and the bag 27 is ready for normal administration by means of the usual I.V. administration apparatus.

Unit 110 will operate in substantially the same manner as previously described for additive transfer device 10 except in the manner in which the holder member 118 is held in a nonrotatable manner. In place of the rib 38 and projection 39 arrangement, the rotation of holder 118 will be prevented by means of contact of the leg portions 140 and 141 with bar members 142 and 143. It will be noted that the legs 140 and 141 in conjunction with the bar members 142 and 143 afford not only a nonrotative relationship but also permit a linear guidance for the holder member as it is moved from the position shown in FIG. 9 wherein the piercing point 123 is out of contact with the diaphragm section 124 to a position shown in FIG. 10 where the piercing point 123 has pierced through the diaphragm section 124. It will be further noted in FIG. 11, that the two leg portions 140 and 141 are arcuate in configuration and thus serve as the guide means 125 for surrounding the rounded additive port 128. Circumferential ribs 145 serve as a finger gripping means in the manner previously described for groove 26.

The foregoing described units are all disposable with the holder members such as 18 formed from polyvinyl chloride and the cover member such as 30 being formed of a polyethylene plastic material. The additive containers such as 11 are composed of glass or polypropylene. Piercing member 23 as well as its correspondingly numbered counterpart are composed of a corrosion resistant steel material and the pierceable stopper such as 16 is composed of a isobutylene elastomer material. Obviously, other materials including various plastics which are inert to I.V. liquids and are readily molded could be utilized in place of the indicated materials to form the various components.

Additive transfer units 10 and 110 have been described for use with a flexible bag of a particular configuration. Obviously, these units would be operable with bags of various configurations as well as bottles of the rigid or semirigid type which have exposed additive ports. Further, "U" shaped bar members 142 and 143 are described as are means for preventing rotation of holder 118 in unit 110. If desired, the bars could be in the form of a solid walled web or rib members.

It will thus be seen that through the present invention there is now provided an additive transfer unit which is simplified in its construction and utilizes a minimum number of parts. The units are packaged in a compact manner and can be activated in a basic one or two-step operation. They are easily mounted over the additive port of an I.V. bag. The additive transfer devices are readily molded from standard molding equipment and do not require any special tooling or fabrication techniques.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. An additive transfer device for storing and transferring of a medicament to a solution container having a pierceable closure comprising:

an additive container for storing the medicament to be transferred, said additive container having rigid walls and a slidable, pierceable stopper in said container;

a holder member;

a piercing member having a channel therethrough for the flow of said medicament and a piercing point on both ends thereof, an intermediate portion of said piercing member secured by said holder member;

guide means defined by said holder member, said guide means positioned from said piercing member and terminating inwardly of one end of said piercing member;

a cover member adapted to extend over said holder member and said one end of said piercing member extending beyond said guide means; and said holder member and said additive container being interconnected to permit movement of said holder member and said piercing member toward said additive container;

so that upon movement of said holder member and container said additive container will initially move over said holder member to effect a piercing of said additive container stopper and upon removal of said cover member and penetration of said solution container closure by the other piercing end of said piercing member, the contents of said additive container can be expelled into said solution container by further movement of said additive container over said stopper and said holder member.

2. The additive transfer device of claim 1 wherein the interconnection between said additive container and holder is comprised of complementary threading.

3. The additive transfer device of claim 2 wherein said activating means is further defined by means to substantially prevent rotary movement of said holder while permitting linear movement of said holder.

4. The additive transfer device of claim 3 wherein said means to substantially prevent rotary movement while permitting linear movement of said holder is defined by interfering rib members extending from said cover and holder members.

5. The additive transfer device of claim 3 wherein said means to substantially prevent rotary movement while permitting linear movement of said holder is defined by an interference fitment between said guide means and said cover member.

6. The additive transfer device of claim 5 wherein said interference fitment defined by said guide means and said cover member includes leg portions forming said guide means and parallel bar members extending from an end wall of said cover member.

7. The additive transfer device of claim 5 further including stop portions defined by said holder member and positioned adjacent the point of merger of said leg portions with said holder member.

8. The additive transfer device of claim 1 wherein said cover member and said vial are interconnected by a friction fit arrangement.

9. A ready-to-use, readily activated three component transfer device for storing and transfering of a medicament to a solution container having a projecting pierceable closure comprising:

a medicament container for storing the medicament to be transferred with a pierceable stopper sealing said medicament in said medicament container;

a holder member having secured thereto a piercing member with a channel therethrough for the flow of said medicament and a piercing point on both ends, said holder member defining guide means for surrounding said projecting pierceable closure and terminating inwardly of one end of said piercing member; and a cover member adapted to extend over said holder member and to engage said medicament container in a sealing manner, said cover member, said holder member and said medicament container defining together means to permit movement of said holder member and said other end of said piercing member toward said medicament container so that one of said piercing points of said piercing member will pierce said pierceable closure and provide a passage for flow of said medicament from said medicament container to said solution container when said other of said piercing points penetrates said projecting pierceable closure of said solution container.

10. The readily activated transfer device of claim 9 wherein said means to effect movement of said holder member toward said medicament container is defined in part by a complementary threading carried by said medicament container and said holder.

11. The readily activated transfer device of claim 10 wherein said activating means is further defined by means to substantially prevent rotary movement of said holder while permitting linear movement of said holder.

12. The readily activated transfer device of claim 11 wherein said means to substantially prevent rotary movement of said holder while permitting linear movement is defined by interfering rib members extending from said cover and holder member.

13. The readily activated transfer device of claim 11 wherein said means to substantially prevent rotary movement of said holder while permitting linear movement is defined by an interference fitment between said guide means and said cover member.

14. The readily activated transfer device of claim 13 wherein said interference fitment defined by said guide means and said cover member includes leg portions forming said guide means and parallel bar members extending from an end wall of said cover member.

* * * * *

UNITED STATES PATENT OFFICE

CERTIFICATE OF CORRECTION

PATENT NO. : 4,169,475

DATED : October 2, 1979

INVENTOR(S) : Joseph N. Genese

It is certified that error appears in the above-identified patent and that said Letters Patent are hereby corrected as shown below:

In column 5, line 57, Claim 3, please delete "said activating means is further defined by" and insert before "to" -- are provided --.

In column 6, lines 49 and 50, Claim 11, delete "said activating means is further defined by" and insert before "to" -- are provided --.

Signed and Sealed this

*Twenty-seventh* Day of *May 1980*

[SEAL]

*Attest:*

SIDNEY A. DIAMOND

*Attesting Officer*

*Commissioner of Patents and Tradema*